United States Patent [19]

Furman

[11] Patent Number: 4,715,827

[45] Date of Patent: Dec. 29, 1987

[54] MODULAR CONNECTOR SYSTEM

[75] Inventor: Lev B. Furman, York, Pa.

[73] Assignee: AMP Incorporated, Harrisburg, Pa.

[21] Appl. No.: 853,306

[22] Filed: Apr. 17, 1986

Related U.S. Application Data

[63] Continuation-in-part of Ser. No. 729,102, Apr. 30, 1985, Pat. No. 4,632,495, Ser. No. 729,103, Apr. 30, 1985, abandoned, and Ser. No. 729,104, Apr. 30, 1985, abandoned.

[51] Int. Cl.[4] ..... H01R 13/502

[52] U.S. Cl. ..... 439/465; 439/275; 439/731; 439/752

[58] Field of Search ..... 339/206 R, 206 P, 210 R, 339/210 M, 219, 136 R, 136 M, 138, 141, 105, 107, 17 LC, 103 M, 105 B, 217 S, 143 R; 439/271–277, 460–469, 731, 752

[56] References Cited

U.S. PATENT DOCUMENTS

| | | | |
|---|---|---|---|
| 3,440,596 | 4/1969 | Frompovicz | 339/206 R |
| 3,503,035 | 3/1970 | Lazar et al. | 339/219 R |
| 3,581,271 | 5/1971 | Knitter et al. | 339/217 S |
| 3,707,696 | 12/1972 | Carter | 339/206 |
| 3,789,343 | 1/1974 | Hirokawa et al. | 339/217 S |
| 3,864,010 | 2/1975 | Wasserlein, Jr. | 339/210 M |
| 3,993,394 | 11/1976 | Cooper | 339/217 S |
| 3,994,555 | 11/1976 | Konno et al. | 339/103 R |
| 4,010,999 | 3/1977 | Hoffman | 339/210 M |
| 4,033,658 | 7/1977 | Asick | 339/210 M |
| 4,050,769 | 9/1977 | Ammon | 339/210 M |
| 4,108,527 | 8/1978 | Douty et al. | 339/107 |
| 4,448,471 | 5/1984 | Berry et al. | 339/91 R |
| 4,534,608 | 8/1985 | Scott et al. | 339/107 |
| 4,615,578 | 10/1986 | Stadler et al. | 339/143 R |

FOREIGN PATENT DOCUMENTS

| | | |
|---|---|---|
| 446128 | 9/1972 | Australia . |
| 0070392 | 1/1983 | European Pat. Off. . |
| 0123590 | 10/1984 | European Pat. Off. . |
| 2313437 | 9/1974 | Fed. Rep. of Germany . |
| 1323749 | 3/1963 | France . |
| 330621 | 6/1958 | Switzerland . |

OTHER PUBLICATIONS

IBM Technical Disclosure Bulletin, vol. 21, No. 10, 3/1979, "Circuit Card Connector Mounting Apparatus", Roy et al.

*Primary Examiner*—John McQuade

[57] ABSTRACT

A modular connector includes a housing (18, 181, 191, 518) having an interior surface adapted to engage a mating external surface of one or more contact-receiving and -carrying modules (20, 210, 520, 521) supported within the housing. The wire contacts (64, 65, 66, 600) are removably supported within the module to permit one or more contacts to be removed and replaced without destruction of the entire module. Mating structures of the housing and the module and the contacts repeatably position the housing portions with respect to one another and precisely position the module within the housing laterally, longitudinally, and vertically and precisely position the contacts within the module. The invention also includes a module (520, 521) having an integral sealing boot (578) formed thereon to provide strain relief and effective sealing around the conductor wires (536, 537) entering into the module and between the module and the housing portions.

44 Claims, 13 Drawing Figures

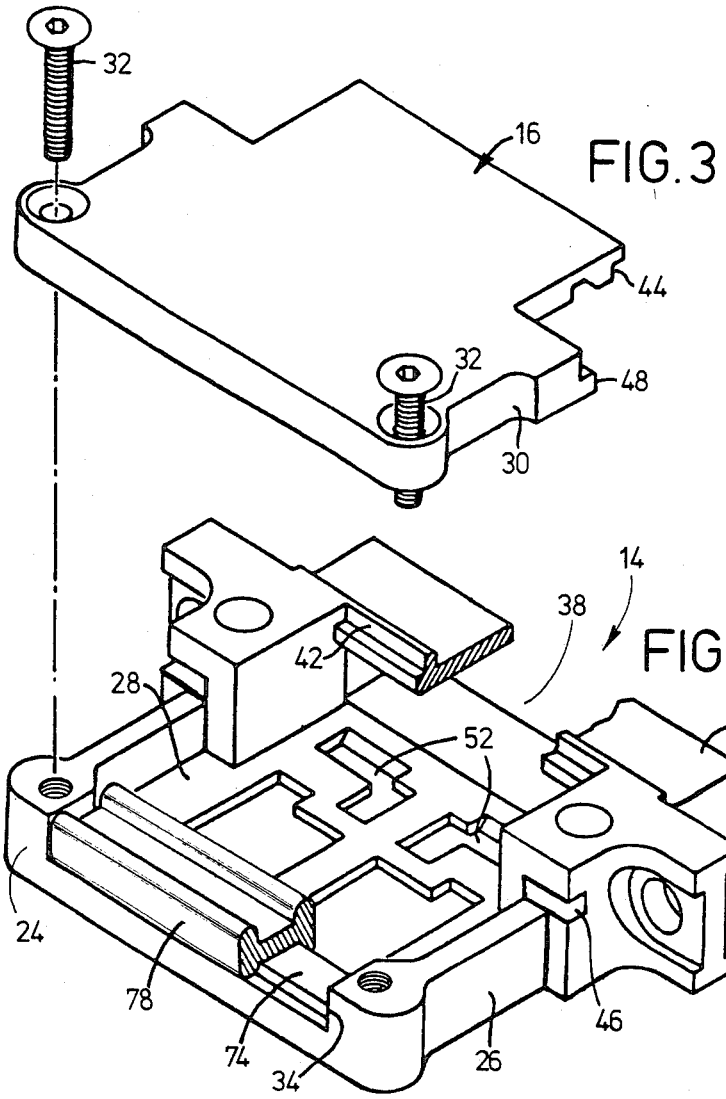
FIG. 3
FIG. 2
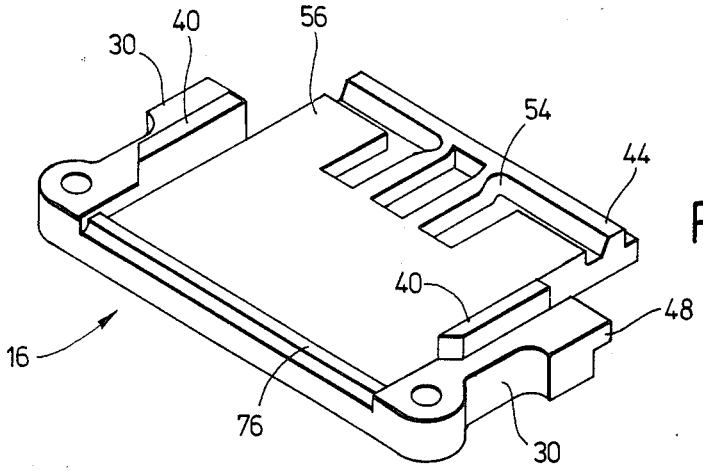
FIG. 4

68
66
70
60
21

58
50
20
50a
50b
50c
60
72
62
64

MODULAR CONNECTOR SYSTEM

This application is a continuation in part of U.S. patent applications Ser. Nos. 729,102 and now U.S. Pat. No. 4,632,495; 729,103; and 729,104 and now abandoned which were filed on Apr. 30, 1985.

TECHNICAL FIELD

This invention relates generally to electrical wiring connectors and, more particularly, to modular electrical connectors having an outer housing supporting one or more internal modules in which various conductor wires to be connected are accommodated in passageways extending through the modules.

BACKGROUND ART

Wiring connectors of various types are well known in the art. Typically, however, such connectors are difficult to manufacture, assemble, and service, thereby increasing the ultimate cost of using such connectors.

Electrical connectors usually comprise an assembly consisting of two connector halves, i.e., a male connector and a female connector, which are adapted to be joined together to form an electrical and mechanical connection between conductors which are terminated in the connector halves. The conductors in each connector half are terminated by suitably configured contacts; and the contacts must be accurately positioned within the connector halves to ensure that they will be in alignment for proper mating when the connector halves are joined together. Misalignment of contacts when the connector halves are joined together can result in improper electrical connection and physical damage to the connector assembly.

Once positioned within the connector halves, it is important that the contacts remain in position notwithstanding frequent connection and disconnection of the connector halves to achieve safe and reliable connector operation over an extended period of time.

In one known connector, illustrated and described in U.S. Pat. No. 3,993,394, a one-piece shell is provided; and a pair of modules or wafers is inserted into the shell by longitudinal movement therein. A rib arrangement is provided on the horizontal surfaces of the modules, and cooperating keyways are formed on the internal horizontal surfaces of the shell in order to prevent lateral movement of the modules within the shell.

However, separate structures are required for preventing longitudinal movement of the modules within the shell. Specifically, spring structures are required to be attached to the inner surface of the shell and to engage the rear portion of the module ribs in order to prevent rearward movement of the modules. In order to withdraw the modules for servicing, a specialized tool must be applied in order to compress the springs to permit the modules to be moved.

Thus, in such a prior art device, it is necessary to provide a structural arrangement within the shell for retaining the springs and further to provide to a user specialized tools to permit withdrawal of the modules. The connector is thus more expensive to fabricate and requires the provision of additional elements to a user.

Moreover, upon compression of the springs for withdrawal of the prior art modules, the springs can be deformed, thus adversely affecting the accuracy of placement of the modules upon reinsertio. Such deformation may become so severe as to render the connector useless and to require a complex substitution of the springs for further utilization.

The above-described known connector is also not fully effective in achieving and maintaining proper positioning of the modules and hence of the contact-terminated conductors therein in the vertical direction as the springs themselves are resilient and the wafers can move thereagainst within the shell. Furthermore, the conductor wires are permanently secured within the modules by a rectangular insulation mass; and if it becomes necessary or desirable to remove or replace one or more of the conductors, the entire module must be replaced.

DISCLOSURE OF INVENTION

It is, accordingly, an object of the present invention to overcome the difficulties of the prior art and to provide a simply fabricated connector.

It is a more specific object of the invention to provide a simply fabricated connector which does not require attachment of separate components thereto in order to lock a module therein.

Yet another object of the invention is the provision of a simply manufactured and easily assembled connector in which longitudinal, lateral, and transverse or vertical movement of an internal module is prevented by structural design of the housing and module components.

It is still another object of the invention to provide a connector arrangement which may be easily serviced without the requirement of special tools therefor.

Yet a further object of the invention is the provision of a connector having a two-part housing which may be readily separated for servicing the module enclosed therein.

It is another object of the invention to provide a connector having internal structural design for locking an internal module from movement therein and for precisely aligning the module, and further including an arrangement for precisely locking contact pins in a longitudinal direction within the module.

It is still a further object of the invention to provide a connector including internal structural features for locking a module therein, the module including components for locking contact pins therein, and including still additional structural features for locking a wiring arrangement and for providing a strain relief therefor.

In accordance with the present invention, a connector is provided which comprises a housing, at least one module adapted to be received within the housing, said module including means for receiving a plurality of electrical conductors therein, and positioning means for positioning said module within said housing, characterized in that said housing includes a receiving portion and a cover portion, said cover portion being releasably mountable to said receiving portion for releasably enclosing said module therein, and further characterized in that said positioning means includes locking means on said housing and said module for locking said module laterally and longitudinally within said housing, said locking means including an interengaging ribbed structure and channel structure on said housing and said module.

In accordance with a presently preferred embodiment, the ribbed structure provides a segmented rib on at least one surface of the module and the channel structure includes a plurality of lateral channel segments on one or more surfaces of the housing for interlocking with the rib segments to prevent both longitudinal and lateral movement of the module within the housing. The rib segments are provided on either the upper or lower surface of the module, and the lateral channels may be provided on an upper surface of the floor of the receiving portion and on a bottom surface of the cover portion. the channels preferably include a number of L-shaped channels.

The receiving and cover portions of the housing include self-aligning structure for automatic alignment of the housing portions upon assembly of the housing. The self-aligning structure of the cover portion preferably includes flanges descending from sidewalls thereof and laterally positioned for engaging inner surfaces of upstanding sidewalls of the receiving portion of the housing, to provide lateral locking of the cover portion with respect to the receiving portion. Additionally, the cover portion preferably includes a front wall for engaging a rear wall of a front segment of the receiving portion, to prevent forward movement of the cover beyond a predetermined position therefor. Finally, a tongue and groove structure may be provided between the cover and receiving portions of the housing to prevent relative vertical movement therebetween.

With the present invention, precise alignment of a module within the housing is achieved in all directions by means of the cooperating rib and channel structure on the housing and the module which prevents longitudinal and lateral movement of the module within the housing and by surfaces on the modules and housing which prevent vertical movement of the module in the housing. The connector of the present invention does not require and does not include separate spring structures to position the module or to retain the module within the housing. To remove the module from the housing in the connector of the present invention, the two housing portions are simply separated and the module removed.

The present invention also includes means for maintaining the contact-terminated conductors accurately positioned within a module. Lateral alignment of the contacts is maintained by extending the contacts into passageways formed in the module. In accordance with one embodiment, longitudinal alignment of the wiring contacts within the module is provided by a number of retention pins. The module may include a plurality of transverse holes for receiving the pins, and the contacts include portions shaped to receive the retention pins. Thus, when the contacts are longitudinally aligned in the module, the retention pins are inserted in the module and engage the shaped portions of the contacts and prevent further longitudinal movement. Preferably the portions of the contacts are shaped to receive one-half a retention pin so that pairs of adjacent contacts face each other and are simultaneously longitudinally locked by a single retention pin.

In accordance with an alternative embodiment of the invention, the contacts include na integral spring finger adapted to engage a surface on the module upon insertion of the contact-terminated conductor wires into the module to prevent rearward longitudinal movement of the contacts within the module. Other surfaces on the contacts and the module limit forward longitudinal movement of the contacts within the module. In this particular embodiment, any contact-terminated conductor may be easily removed from the module by use of a special tool inserted into the module. In all embodiments of the present invention, separate conductors can be readily removed from the module at any time and replaced or repaired without replacing the entire module.

Additionally, the connector structure of the present invention preferably includes rear walls descending from the cover and upstanding from the receiving portion in order to provide strain relief for the wiring arrangement by compressing the wiring therebetween. In accordance with one embodiment of the invention, a separte strain relief pad may be provided for that purpose, to provide a bend in the wiring arrangement.

In an alternative embodiment of the invention, the module includes an integral sealing boot on the rear end thereof having apertures through which the incoming conductor wires extend. The sealing boot is positioned on the module to be compressed between the receiving and cover portions of the housing upon assembly of the housing to effect a seal around the conductors and to generally seal between the module and the housing. The sealing boot also provides effective strain relief for the conductors by transferring any bending forces on the external conductors away from the locations where the conductors are connected to the contacts and the protective insulating covering has been removed from the wires.

In accordance with a preferred embodiment of the invention, the sealing boot includes rippled surface portions; and surfaces on the housing portions include similar rippled configurations that are adapted to contact and compress the sealing boot to more effectively seal around the wires. The housing portions also include suitable positioned slots for receiving portions of the compressed sealing boot to improve the effectiveness of the sealing boot.

In accordance with yet a further embodiment of the invention, the connector may include one or more modules either or both having one or more rows of passageways for supporting one or more rows of conductor wires therein. The housing may include a receiving portion and one or more cover portions. The connector can also be configured as a right-angle connector for use in applications where a right-angle connector is appropriate.

Still other objects and features of the present invention will be apparent to those skilled in this art from the following description wherein there is shown and described several embodiments of the invention suited to carry out the invention. As will be realized, the invention is capable of still other, different embodiments; and its several details are capable of modifications in various aspects, all without departing from the invention. Accordingly, the drawings and the descriptions will be regarded as illustrative in nature, and not as restrictive.

BRIEF DESCRIPTION OF DRAWINGS

FIG. 2 illustrates the receiving portion of the housing of the female half of the connector assembly of FIG. 1;

FIG. 3 illustrates the cover portion of the housing of the female half of the connector assembly of FIG. 1;

FIG. 4 illustrates the internal surface of the cover portion of FIG. 3;

BEST MODES FOR CARRYING OUT THE INVENTION

Figure 1:
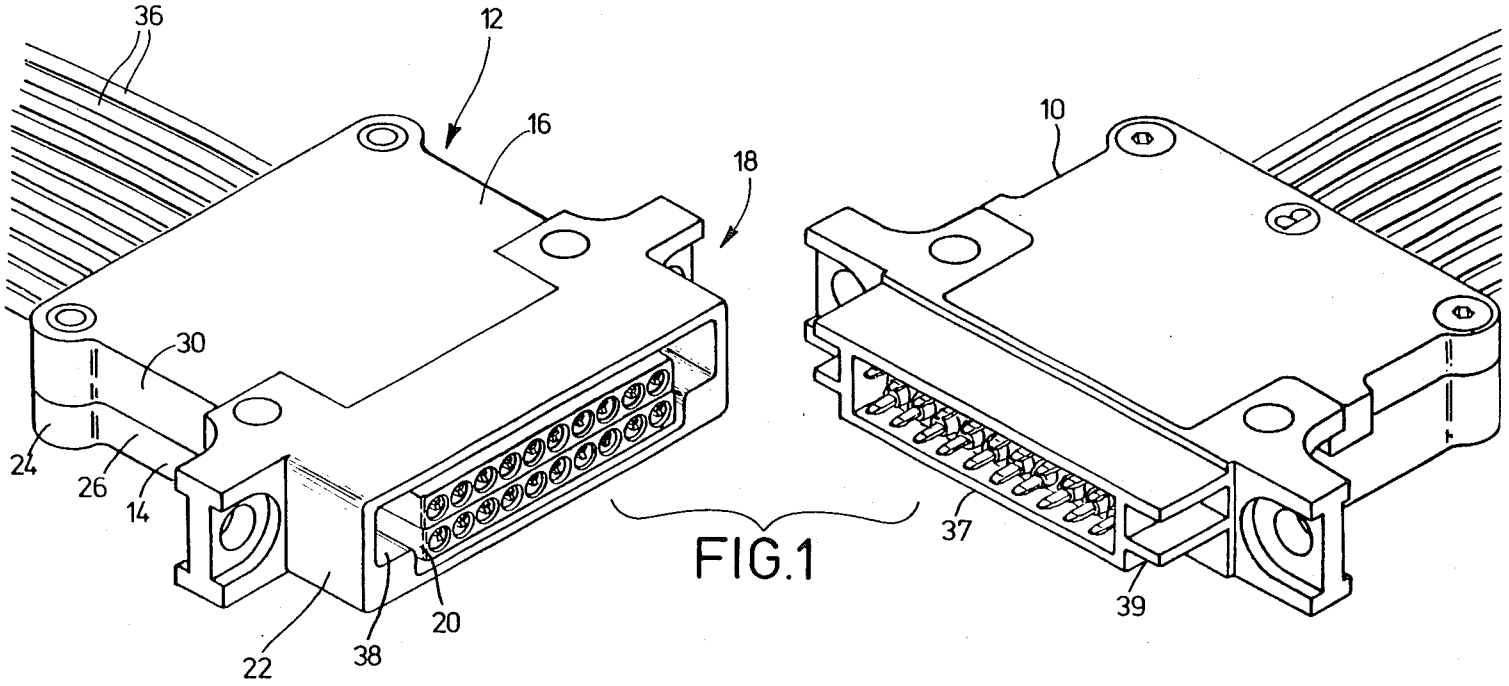
FIG. 1 illustrates a connector assembly in accordance with one embodiment of the present invention.

Referring to FIG. 1, there is shown a perspective view of two halves of a connector assembly in accordance with one embodiment of the present invention. A male connector, generally designated at 10, is shown along with a female connector, generally designated at 12. With the exception of the type of contact used for the wiring arrangement and the projection of the module at the forward end of the connectors, the following description, which is directed toward the female connector 12, is applicable essentially identically to the structure of the male connector 10.

As shown in the Figure, female connector 12 includes a receiving portion 14 and a cover portion 16 which, together, generally form a housing 18 for a module 20, the forward end of which is seen in FIG. 1. The receiving portion has a front portion 22 and a rear portion 24, generally connected by upstanding sidewalls 26. Preferably, the housing is die cast aluminum, although stainless steel or plastic materials may be used.

As shown in FIG. 2, the receiving portion 14 includes a floor portion 28 connecting the rear portion 24, upstanding sidewalls 26, and the front portion 22.

The cover portion 16 is shown in FIGS. 3 and 4, the internal details being shown in FIG. 4 which illustrates the cover in an inverted position. As is apparent from FIGS. 3 and 4, cover 16 includes depending sidewalls 30 designed for mating with the upstanding sidewalls 26 of the receiving portion 14 of the housing. Thus, when cover 16 is mounted on receiving portion 14 and is fastened thereto by fasteners illustrated as screws 32, a substantially closed housing structure reesults with a rear opening 34 for receiving wiring arrangement 36 (shown in FIG. 1) therein and with a front opening 38 permitting access to the contacts provided at the forward end of module 20. The housing structure, including the cooperating sidewalls, 26 and 30, provides shielding for the exposed wire terminals and contacts housed therein.

As shown in FIG. 1, the forwardly projecting contacts of male connector 10 are surrounded by an enclosure 37 including outwardly projecting horizontal fins 39. Enclosure 37 is dimensioned to fit within the opening 38 in female connector 12 upon connection of the connector assembly. Fins 39 are similarly dimensioned to fit within opening 38. The fins thus provide proper lateral alignment of the enclosure 37 within opening 38, thereby assuring a desired mating contact between corresponding male and female connectors.

In order to lock the cover 16 in the receiving portion 14 and to prevent relative lateral and longitudinal movement therebetween, there are provided a number of interengaging surfaces, such as flanges 40, shown in FIG. 4, descending from the sidewalls 30 of the cover. Flanges 40 are inwardly laterally spaced on sidewall 30 in order to engage inner surfaces of upstanding walls 26 of the receiving portion of the housing. Thus, lateral movement of the cover with respect to the receiving portion is prevented by abutment of flanges 40 against the inner surfaces of upstanding walls 26. Additionally, in order to prevent forward movement of the cover relative to the receiving portion of the housing, there is provided a rear vertical wall 42 of the front portion 22, as shown in FIG. 2. Similarly, a front wall 44 is provided in the structure of cover 16, as shown in FIGS. 3 and 4, for engaging rear vertical wall 42 when the cover is mounted to the receiving portion. A still further alignment structure includes a groove 46 in the housing and a matching tongue 48 in cover 16 as shwon in FIGS. 2 and 3. the tongue and groove arrangement is provided for vertically locking the cover to the receiving portion.

Thus, in order to assemble the cover to the receiving portion, the cover is first laterally aligned with the receiving portion and is placed rearwardly of its finally assembled position. The cover 16 may then be slid forward slightly to obtain engagement of the tongue and groove arrangement 48, 46 and further to obtain an abutment between front wall 44 of the cover and rear vertical wall 42 of the receiving portion. Once such abutment is attained, the cover is locked from any further lateral, vertical, or forward longitudinal movement with respect to the receiving portion.

Accordingly, the cover and receiving portion include a cooperating, self-aligning structure for simplified alignment and assembly of the cover to the receiving portion to form the housing of the present connector.

Figures 5, 6:
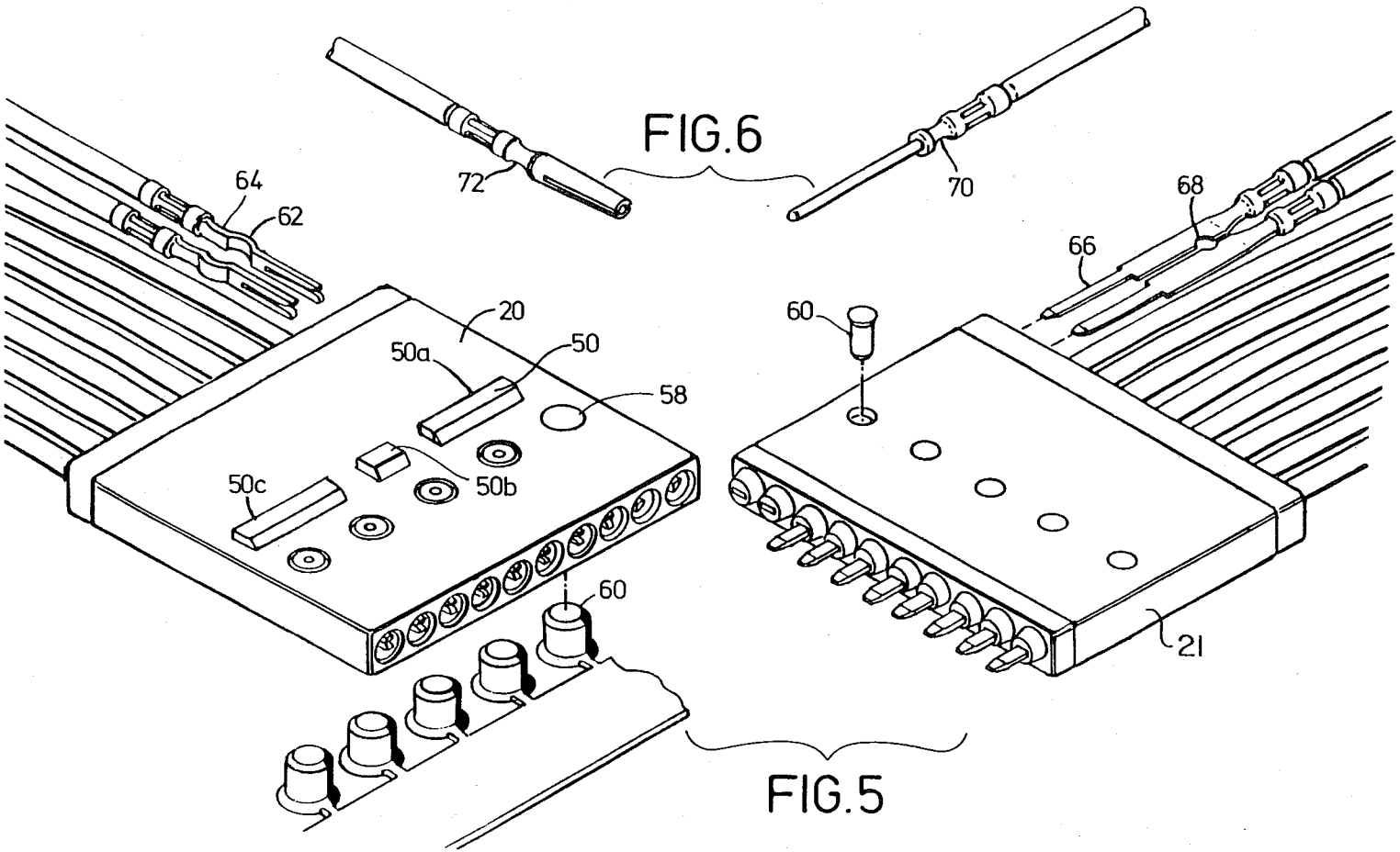
FIG. 5 is a partially disassembled view illustrating the modulesl of the connector assembly of FIG. 1 and contact-terminated conductors supported therein.
FIG. 6 illustrates an alternative type of contact set which may be utilized in the connector assembly of FIG. 1.

FIG. 5 illustrates the two modules used in the two halves of the connector assembly shown in FIGS. 1–4 and the contact structure affixed to the wiring arrangement provided therein. With the exception of the male and female contacts and their connection to the front portions of the two modules, the modules are substantially identical.

Preferably, the modules are made of a plastic material capable of withstanding high temperatures, such as polyethylene ether ketone although other materials may also be used.

Module 20, shown in detail in FIG. 5, is provided with a segmented rib structure 50 in which rib segments 50*a*, 50*b*, and 50*c* are arranged laterally on an upper surface of the module and are laterally spaced apart from one another. The rib segments 50*a*, 50*b*, and 50*c* may each be provided with angled wedge-like forward faces. A similar ribbed structure may be provided on the bottom surface of the module, although it is preferable that the ribbed structure be provided on either the top surface or the bottom surface and not on both surfaces. In order to avoid confusion as to the orientation of the module, the segmented rib structure 50 provided on the top surface of the module will preferably differ in configuration from the rib structure provided on the bottom surface.

In use, the connector according to the invention is assembled by placing module 20 within receiving portion 14 of the connector. As shown in FIG. 2, a number of channels are provided on floor portion 28 of the receiving portion. Specifically, lateral channel segments 52 are provided for a generally L-shaped channel structure shown therein. The channel segments 52 may be provided with angled wedge-like forward faces that mate and engage the forward faces of the rib segments. The channel arrangement on floor portion 28 corresponds to the rib structure of module 20 so that all sides of the rib segments are engaged by the vertical and slanted surfaces of the channel segments 52. Accordingly, once being so engaged, the module 20 is locked both longitudinally and laterally by the channel structure and is fixed laterally and longitudinally relative to the receiving portion 14 of the housing.

As is further shown in FIG. 4, a number of channel segments 54 are provided on a bottom surface 56 of the cover 16. Channel segments 54, cooperating with the rib structure 50 on the upper surface of the module, also provide a structure for locking the module both longitudinally and laterally within the housing. When the module 20 is seated within the receiving portion of the housing, cover 16 may be assembled to form the connector by moving the cover forwardly in contact with the module until the segmented rib 50 mates with and engages channel segments 54. The rib structure and channel segments are arranged on the module and cover, respectively, so that engagement occurs at a point in which the tongue and groove arrangement 48–46 provides vertical interlocking for the cover and receiving portion of the housing.

Thus, once the cover is properly seated on the module, the connector is substantially fully assembled; and any further lateral, longitudinal, or transverse movement of the module is prevented inasmuch as the module is locked in position by the receiving portion or by the cover portion of the housing, or by both, since the cover is vertically locked by the tongue and groove arrangement 48–46.

For convenience in manufacture, the channel structures 52, 54 are provided on both the inside surface of the cover 16 and on the floor surface of the receiving portion. It is preferred, however, that the complementary ribbed structure be provided on only one surface of the module and that the other surface be flat. Where two sets of engaging rib-channel structures are used to engage the module, there is a possibility for conflict and improper assembly of the module.

The resulting assembly forms the female connector 12 of FIG. 1. A similar module 21, shown in FIG. 5, may be used for assembling the male connector 10 of FIG. 1. Although not shown in FIG. 5, the male module 21 is provided with a segmented rib structure for lockably engaging the interior of the male connector housing.

Referring again to the female connector structure, it is noted that in order further to assure longitudinal locking of the module 20 within the housing, the front portion 22 of the housing is preferably dimensioned to permit passage of the module structure therethrough, but not to permit passage of the ribbed portions 50 therethrough. Specifically, the vertical dimensions of the front portion 22 of the housing may be somewhat larger than the dimension of the module 20 and somewhat smaller than the dimension of the ribs projecting outwardly from the module. Of course, ribs may be provided on the sidewalls of the module 20, and the lateral dimensions of the front portion of the housing may be similarly arranged to block passage of the ribbed segments therethrough.

In yet a further arrangement, sidewall portions 26 of the receiving portion 14 may be provided with channels for locking with any mating ribs on the side portions of the module.

FIGS. 5 and 6 show an arrangement of the present invention for longitudinally locking the contacts within the module and thus within the connector.

Specifically, it is noted that transverse holes 58 are provided in the module. Retention pins 60 are provided for insertion in the holes 58. The retention pins engage a shaped portion 62 of a contact 64 as shown in FIG. 5.

More specifically, for a tuning fork type of receptacle contact, a curved portion 62 is provided matching the curvature of the retention pins 60. The shaped portion 62 is located so that, upon engagement by a pin 60, the forward end of a contact 64 will be at the proper longitudinal position within the longitudinal passageway provided therefor in module 20 to receive the forward end of male contact 66. Thus, once the contact is properly positioned within the passageway, pin 60 is inserted in the hole 58 to lock the contact from further longitudinal movement.

Advantageously, the number of retention pins may be less than the number of contacts and wires retained in the module. As shown in FIG. 5, the adjacent contacts preferably each include a shaped portion 62 matching the shape of one half of a retention pin 60. Thus, two contacts together are engaged by a single retention pin. Since the pin is prevented from longitudinal and lateral movement by the dimensions of hole 58, contacts 64 are similarly prevented from such movement.

Referring to the male contact, shown at 66, a similar arrangement is provided by providing a stamped semi-circular hole at 68, thus providing an appropriately shaped portion for engagement by a retention pin. Again, by arranging the contacts to have semi-circular-shaped portions facing each other, rather than providing each pin with a fully circular-shaped portion, only one retention pin is required for each pair of contacts retained by the module.

While the foregoing discussion relates to a tuning fork type of contact, the present concept is applicable to a pin-and-socket arrangement as well. FIG. 6 illustrates a pin-and-socket contact arrangement in which a pin and socket are provided with an appropriate arcuate encircling groove or chamfer at 70 and 72, permitting the use of the retention pin arrangement hereinabove described with reference to FIG. 5. An advantage of the structure of FIG. 6 is that the pin-and-socket contacts need not be specially positioned, and pairs of adjacent contacts will engage the retention pins no matter how they are rotationally oriented when inserted into the module.

Thus, the inventive structure permits a simplified locking of a contact within a module, together with a simplified structure for locking a module within a housing for precisely defining the positions of the contacts within the connector and for assembling the entire connector.

Yet another feature of the invention is shown with reference to FIGS. 2 and 4 which show upstanding wall 74 and descending wall 76, respectively associated with the rear portions of the receiving and cover portion of the housing. These two walls define therebetween a space accommodating the wiring arrangement passing therethrough.

Where the connector of the present invention is to be used with a single type of wiring arrangement, such as a ribbon cable of a predetermined thickness, the upstanding and descending walls 74 and 76 may be appropriately dimensioned in order to provide additional shielding and to enable the ribbon cable to be clamped therebetween, thus providing strain relief for the connections between the wires and contacts within the module. In that regard, a strain relief pad 78 is provided, providing mating surfaces for engagement of the walls 74 and 76. Passage of a wiring arrangement between the pad 78 and the wall 76, or alternatively between pad 78 and wall 74, provides an appropriate tortuous path for the wiring arrangement, thus crimping the same to provide the desired form of strain relief.

By appropriately positioning the forward edge of the walls 74 and 76, yet another structure may be provided for preventing longitudinal backward movement of the module within the housing.

Figure 7:
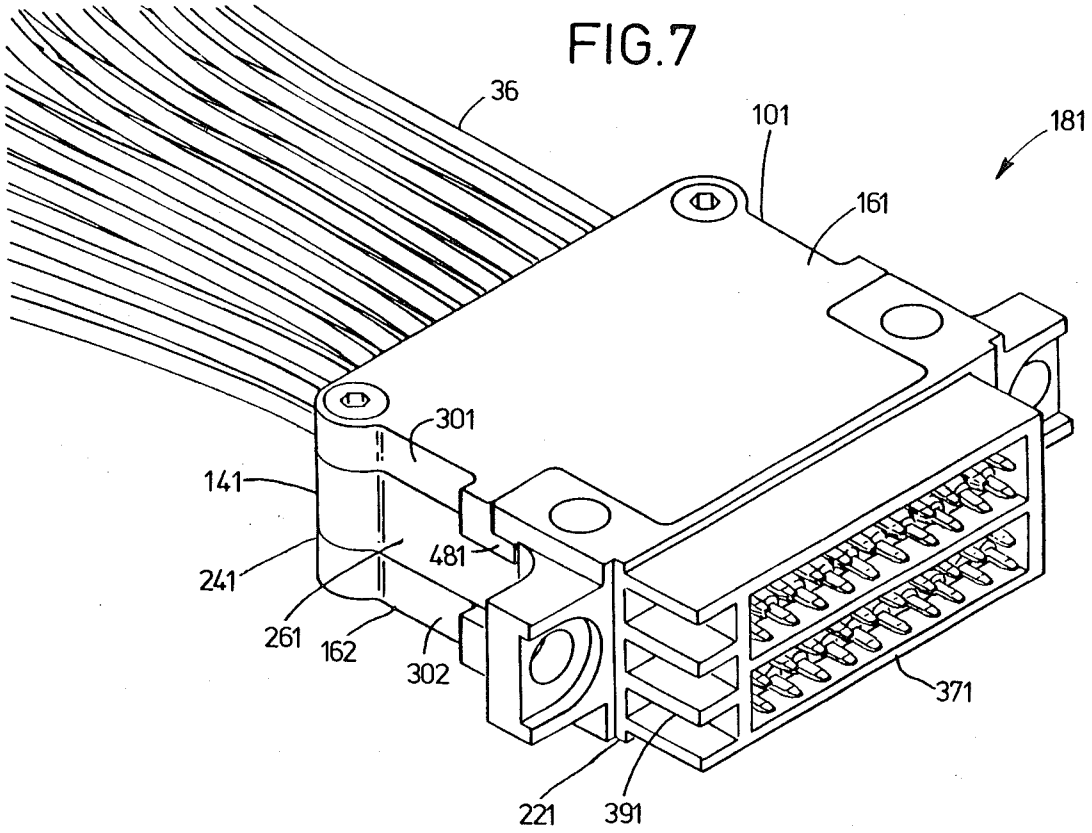
FIG. 7 illustrates a connector assembly for a plurality of rows of conductors in accordance with an alternative embodiment of the invention.

FIG. 7 illustrates an alternative embodiment of the invention in which the connector halves include a plurality of stacked modules. FIG. 7 shows an assembled, double male connector half 101 which includes a receiving portion 141 and a cover therefor. Although the receiving portion 141 may include a floor portion, as described for the embodiments of FIGS. 1–5, the receiving portion is formed as a central portion open at its top and bottom in the arrangement shown in FIG. 7. First and second covers 161 and 162 are provided for the top and bottom of the receiving portion 141. the receiving portion of FIG. 7 is larger than that shown in FIG. 2 in order to accommodate a pair of modules.

Thus, the receiving portion 141 and top and bottom covers 161 and 162 form a housing 181 to enclose a pair of modules. Although a pair of modules is described for the housing 181 of FIG. 7, a single module may be provided therein, the single module having a sufficiently large vertical dimension to accommodate a number of horizontal rows of wires and contacts to pass therethrough. In accordance with the previously described structure, housing 181 may be formed by a receiving portion 141 integrally formed with a floor portion (as if the bottom cover 162 were integral with receiving portion 141) and a top cover 161, or as the above-described open-ended receiving portion with a pair of covers. In either case, where a single, enlarged module is housed therein, the module may include an arrangement of rib structures similar to those shown in FIG. 5 while the top cover may include a channel arrangement as shown in FIG. 4. Similarly, the bottom cover 162 or the floor portion of an integral receiving portion 141 may be provided with the channel structure shown in FIG. 2.

Where a pair of modules is utilized, preferably each module includes a rib structure for interlocking with the corresponding cover or floor portion, the internal vertical dimension of the housing being such as to require the ribs to mate with the channels in order to permit fastening of the cover or covers to the receiving portion.

Of course, although the foregoing describes the locking arrangement for the modules as including ribs on the modules and channels on inner surfaces of the housing, a reverse arrangement may be utilized in which the ribs protrude from various inner surfaces of the housing and in which the channels are provided in the corresponding module surfaces.

As yet a further locking structure, there may be provided a rib and channel arrangement between two modules which are to be received within housing 181. Particularly, one of the modules may include a protruding rib structure, and the other such module may include a corresponding channel arrangement.

As shown in FIG. 7, the receiving portion is formed of a front portion 221 and a rear portion 241, and includes upstanding sidewalls 261. The covers 161 and 162 include depending sidewalls 301 and 302 respectively which mount on the sidewall 261 of the receiving portion. Preferably, flanges are provided for the depending sidewalls 301 and 302 as described in connection with the structure of FIG. 4. A tongue portion 481 is preferably provided for the covers 161 and 162 to engage the housing and thus to align the cover thereto.

The structure of FIG. 7 illustrates a male connector like that shown at 10 in FIG. 1 and includes an enclosure 371 for the protruding contacts. A plurality of fins 391 may be provided in order to align the male contacts with the female contacts of a female connector, as hereinabove described with reference to FIG. 1.

Figure 8:
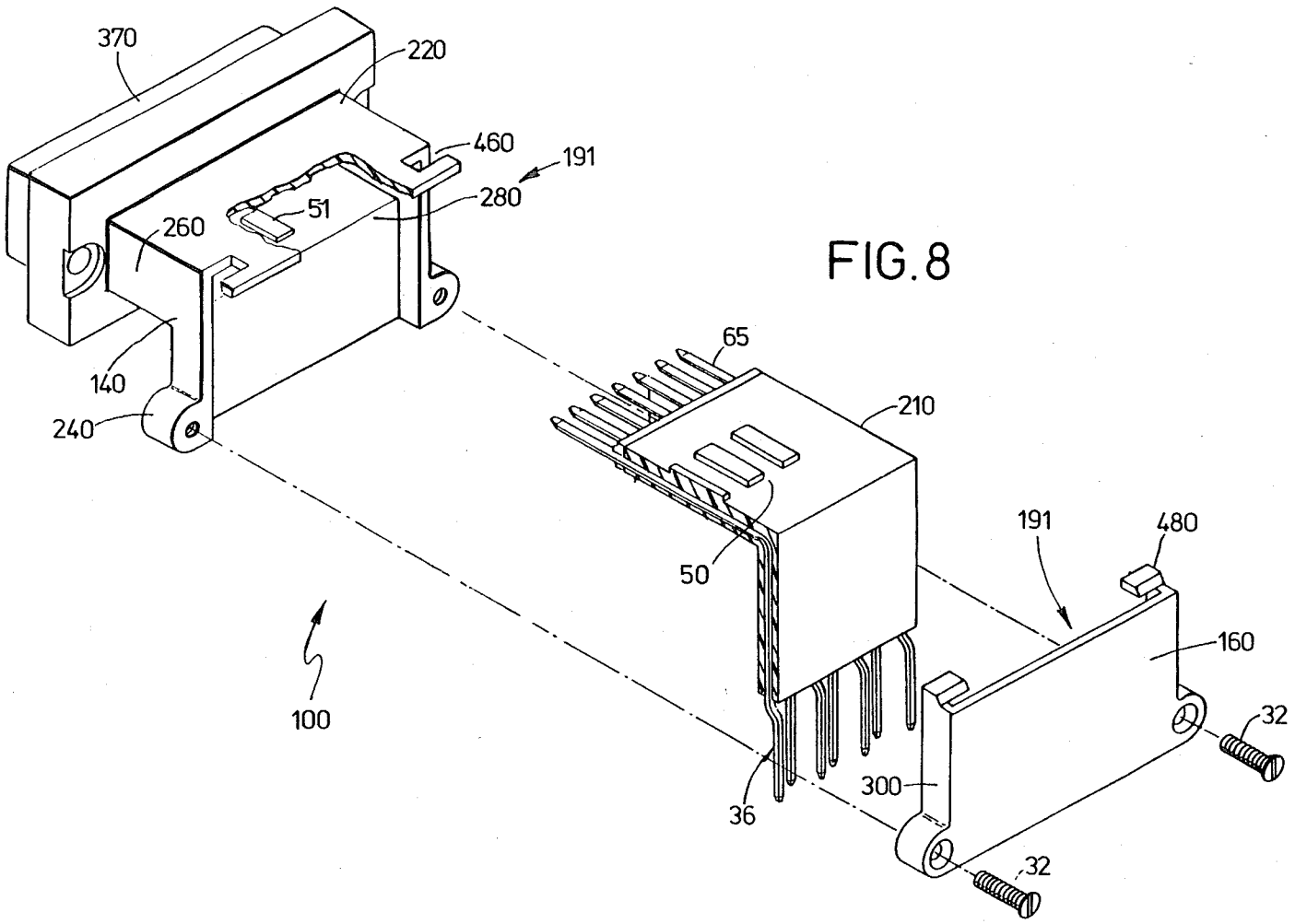
FIG. 8 illustrates a right-angle connector in accordance with yet a further embodiment of the invention.

FIG. 8 shows a right-angle connector in accordance with yet a further embodiment of the present invention. The connector of FIG. 8 generally embodies the various features hereinabove described for the simplified in-line connector illustrated in FIGS. 1–5.

Specifically, a right-angle male connector 100 is generally shown as including an L-shaped receiving portion 140 and a cover portion 160 defining a housing 191. The right-angle connector houses an L-shaped module 210, illustratively shown as a male module. The receiving portion 140 includes a front portion 220 and a rear portion 240, connected by upstanding sidewalls 260 therebetween. The sidewalls, similarly to the receiving means itself, are L-shaped.

The receiving portion 140 includes an L-shaped floor portion 280 connecting the sidewalls 260, the front portion 220, and the rear portion 240. Similarly to the in-line connector described in detail above, cover portion 160 provides depending sidewalls 300 for mounting on at least a portion of the upstanding sidewalls 260 of the receiving portion.

Although the cover portion 160 is shown substantially as a planar structure, the cover may, similarly to the module 210, be L-shaped.

As shown in FIG. 8, the module includes a segmented rib structure 50 in which a number of laterally spaced rib segments are provided on at least one surface. Although the rib segments are shown on the upper portion of the L-shaped module, it should be understood that similar segments may be provided on the vertical portion, as well as on side portions thereof. Moreover, the rib segments may similarly be provided on the hidden horizontal and vertical surfaces of the module.

Similarly to the in-line structure, the floor 280 of the receiving portion 140, the inner surface of cover portion 160, as well as other inner surfaces of the housing, include channels for appropriately interlocking with the rib segments. Alternatively, as shown in FIG. 8, the preferred embodiment includes a rib structure 51 on the floor portion 280; and a channel structure (not shown) is provided on the bottom surface of module 210 for interlocking with the rib structure 51.

In view of the L-shaped structure of the connector shown in FIG. 8, the various rib and channel interlocking sections are generally shown as including longitudinal portions only, for preventin glateral movement between the module and the housing. The L-shaped arrangement secures the module longitudinally against the inner surfaces of the housing by providing an abutment between the inner vertical surface (not shown) of module 210 and the vertical surface of the floor portion 280. Of course, the lateral rib and channel portions may be provided in the right-angle connector embodiment shown in FIG. 8.

Again, additional ribs may be provided on the vertical surface of the module 210, with an appropriate channel structure on the inner surface of the cover portion 160. Alternatively, the ribs may be provided on the inner surface of the cover and a channel structure provided on the vertical surface of the module.

Similarly to the male connector portion 10 shown in FIG. 1, the inventive structure includes an enclosure 370 at the forward end thereof for insertion in an opening of the female connector. Additionally, as shown at 460 and 480 in FIG. 8, the inventive structure provides the groove and tongue arrangement previously described in relationship to the in-line assembly of FIGS. 2 and 3. Thus, a groove 460 is provided in the L-shaped receiving portion; and a tongue 480 is provided in the cover portion for mating with groove 460 thereby to lock the upper portion of cover 160 relative to the receiving portion. Fasteners shown in the form of screws 32 are used to fasten the cover to the receiving portion.

Accordingly, in order to assemble the connector shown in FIG. 8, the module 210 is slid into enclosure 370 of receiving portion 140. Any ribs 50 and 51 provided on the module and/or the receiving portion engage corresponding channels provided on the inner surface of the receiving portion or on the module, respectively, thus assuring proper lateral arrangement of the module within the housing. Cover portion 160 is thereafter fastened to the receiving portion by the tongue and groove arrangement and by fasteners 32, and any flanges and rib and channel structure which may be provided in the cover and module lock the cover laterally with respect to the module. Fastening screws 32 are used to finalize the assembly of the inventive right-angle connector.

Although not illustrated in the embodiment of FIG. 8, the arrangement used in the embodiment of FIG. 5, including retention pins and transverse holes in the module, may be used to lock the contacts from the longitudinal movement within the connector of FIG. 8. Howver, the L-shaped structure provides advantageously, its own longitudinal locking for the contacts. Thus, the preferred embodiment does not utilize the retention pin structure.

Figure 9:
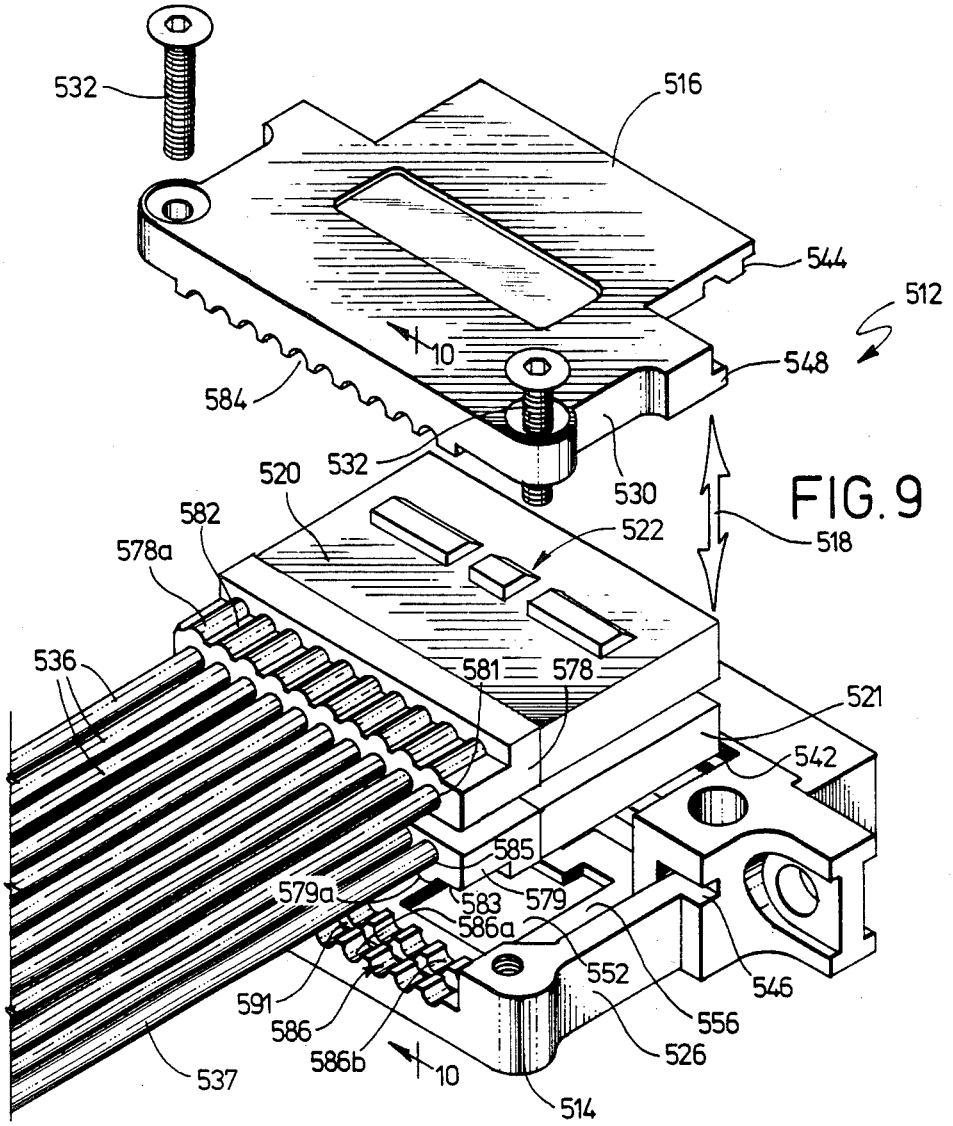
FIG. 9 is an exploded perspective view illustrating the female connector half of a connector assembly in accordance with a presently most preferred embodiment of the invention.

FIGS. 9–13 illustrate a connector assembly in accordance with a further alternative embodiment of the invention. FIG. 9 is an exploded perspective view of the female connector half 512 of the connector assembly. As in the previous embodiments, the male connector half is substantially identical to the female connector half, except for the contact structure and the mating structure; and there is, therefore, no need for a duplicate description of the female connector half.

Connector half 512 includes a housing 518 composed of a receiving portion 514 and a cover portion 516. One or more modules are adapted to be positioned repeatably within the housing 518 by a variety of alignment features similar to those described and illustrated with respect to the embodiment of FIGS. 1–5. In the embodiment of FIG. 9, two modules 520 and 521, each having a single row of passageways for receiving a single row of conductors 536 and 537, respectively, are positioned within housing 518. If desired a single module having two or more rows of passageways for receiving two or more rows of conductors may be positioned in housing 518.

The embodiment of FIGS. 9–13 includes a structure similar to that illustrated and described with reference to the embodiment of FIGS. 1–5 for mounting and aligning cover portion 516 to receiving portion 514. For example, cover portion 516 includes depending sidewall portions 530 designed to mate with upstanding sidewalls 526 of the receiving portion 514 so that when the cover is mounted on the receiving portion and is fastened thereto by fasteners 532, a substantially closed housing structure is provided for enclosing and supporting the modules 520 and 521. Flanges (not shown) are provided on the cover 516 to engage inner surfaces of the upstanding wall 526 of the receiving portion to prevent lateral movement of the cover with respect to the receiving portion when the two portions are secured together. To prevent forward movement of the cover 516 relative to the receiving portion 514, a rear vertical wall 542 at the front of the receiving portion 514 engages front wall 544 of the cover 516. To vertically lock the cover 516 to the receiving portion 514, tongues 548 on cover portion 516 engages grooves 546 in receiving portion 514.

The embodiment of FIGS. 9–13 also includes a structure similar to that in the FIGS. 1–5 embodiment for retaining the modules 520 and 521 within the housing 518 and for defining the lateral, longitudinal, and vertical position of the modules in the housing. For example, receiving portion 514 includes a plurality of channels 552 adapted to engage a rib structure (not shown) on the lower surface of module 521 when the module is placed within the housing to position the module and prevent both lateral and longitudinal movement of the module within the housing. A plurality of channels (not shown) is also provided on the underside of the cover portion 516 to engage rib structure 522 on the top surface of the module 520 to position and lock module 520 within the housing. In order to avoid confusion as to the orientation of the modules, the interengaging rib and channel structure on the lower surface of cover portion 516 and the upper surface of module 521 differs in configuration from the interengaging rib and channel structure on the upper surface of receiving portion 514 and the lower surface of module 521. Preferably also, the lower surface of module 520 and the upper surface of module 521 are smooth and without any interengaging structure which could conflict with the interengaging structures between the modules and the housing portions.

The connector of FIGS. 9–13 differs from that in FIGS. 1–5, however, in the manner in which the contacts are positioned and retained within the modules, and in the construction of the housing and the modules to effectively seal around the conductor wires entering into the modules. As shown in FIG. 9, strain relief pad 78 has been replaced by sealing boots 578 and 579 integral with modules 520 and 521, respectively. Sealing boots 578 and 579 comprise a soft, pliant, chemically inactive material, such as a fluorosilicone polymer, and are bonded to the back edges of the modules 520 and 521, respectively, by a vacuum-bonding process so that portions **578*a* and 579*a* of the sealing boots will extend beyond the rear edges of the modules. Sealing boots 578 and 579 are formed with a plurality of paertures 581 and 585, respectively, which are aligned with passageways in the modules 520 and 521 for receiving conductor wires 536 and 537**.

The upper surface 582 of extended portion 578*a* of the sealing boot 578 and the lower surface 583 of extended portion 579*a* of sealing boot 579 are of generally rippled configuration and are defined by a plurality of spaced, generally semi-circular segments that are coaxial with the apertures 581 and 585, respectively, in the sealing boots. Rippled surfaces 582 and 583 are adapted to be engaged by complementary rippled surfaces 584 and 586 provided on the rear edges of the cover and receiving portions, respectively, of the connector housing. Sealing boots 578 and 579 seal around the conductor wires 536 and 537 entering into the modules 520 and 521 and betwen the modules and the housing. When the modules 520 and 521 are positioned in receiving portion 514, and cover 516 is secured in place, the rippled surfaces 584 and 586 will engage the rippled surfaces 582 and 583 ont he extended portions 578*a* and 579*a* of sealing boots 578 and 579 and compress the sealing boots and effect a seal at the rear end of the connector. The rippled configuration on the sealing boots and on the housing portions results in the compressive forces being applied generally radially around each of the semi-circular ripples and substantially radially around each of the conductor wires 536 and 537 to ensure a more complete seal around the wires.

Figure 10:
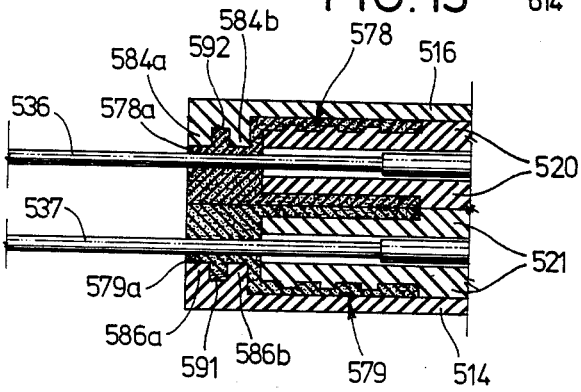
FIG. 10 is a cross-sectional view, taken along the line 10—10 of FIG. 9, of a portion of the connector half of FIG. 9 in assembled form to illustrate a feature of the present invention.

As shown in FIGS. 9 and 10, the rippled surface 586 on the receiving portion 514 is composed of two portions 586*a* and 586*b* separated by a narrow groove 591 extending laterally across the receiving portion. A similar groove 592 (FIG. 10) is provided in the cover portion 516 to divide the rippled surface 584 thereon into two portions 584*a* and 584*b*. The grooves are illustrated in greater detail in FIG. 10 which is a cross sectional view of the rear portion of the connector of FIG. 9 in assembled form. As shown in FIG. 10, when the housing portions 514 and 516 are mounted together and extended portions 578*a* and 579*a* of the sealing boots 578 and 579 are compressed therebetween, portions of the pliant sealing boots 578*a* and 579*a* will extend into the grooves 591 and 592 within the receiving portion and cover portion, respectively, of the housing. The grooves thus help support the sealing boots within the connector. The sealing boots also cooperate with the housing to provide strain relief for the conductor wires 536 and 537 by isolating the locations where the wires are connected to the contacts from any bending forces applied against the conductor wires, thus transferring stress to the location where the wires enter the sealing boots. Sealing boots 578 and 579 illustrated in FIGS. 9–10 provide an effective, reliable seal around the conductor wires and of the rear end of the connector. The sealing boots are preferably integral with the module, avoiding the need for a separate sealing member as in the embodiment of FIGS. 1–5.

Figure 11:
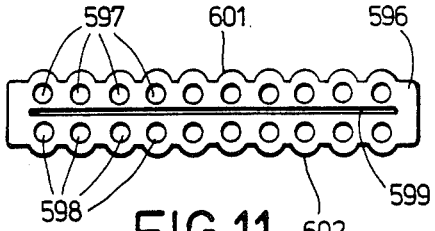
FIG. 11 is a rear view of a sealing boot that may be mounted to modules having two rows of conductors supported therein.

Rather than providing two modules in housing 518, a single module having two or more rows of passageways for receiving two or more rows of conductors may be provided. FIG. 11 illustrates a rear view of a modified sealing boot 596 for such a module. In particular, in FIG. 11, sealing boot 596 has two rows of apertures 597 and 598 positioned to be aligned with corresponding conductor wire-receiving passageways in the module to which boot 596 is mounted. A rippled surface 601 and 602 is provided on both the upper and lower surface of the extended portion of the sealing boot to cooperate with ripped surfaces 584 and 586 on the cover and receiving portions of the housing. In addition, a slot 599 is provided in the sealing boot between the two rows of apertures 597 and 598 and extends substantially across the width of the sealing boot. Slot 599 somewhat isolates the compressive forces applied against surface 601 by surface 584 of cover 516 from the compressive forces applied against surface 602 by the surface 586 of receiving portion 514 to enhance the reliability of the sealing boot. Slot 599 preferably extends within extended portion of the sealing boot from the rear face of the sealing boot to the back edge of the module.

Figure 12:
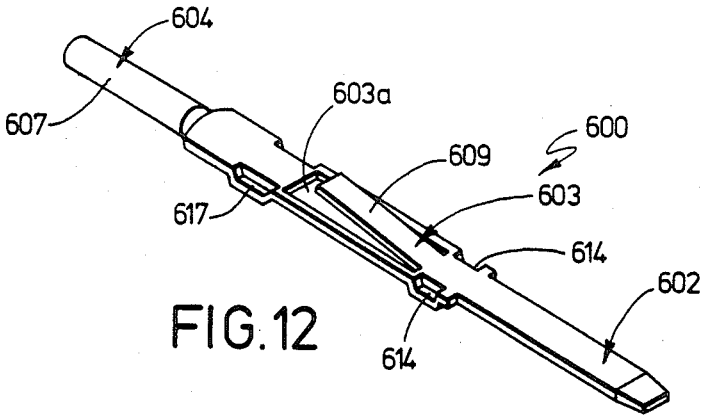
FIG. 12 is a perspective view of a contact which may be used in the connector assembly of FIG. 9.
Figure 13:
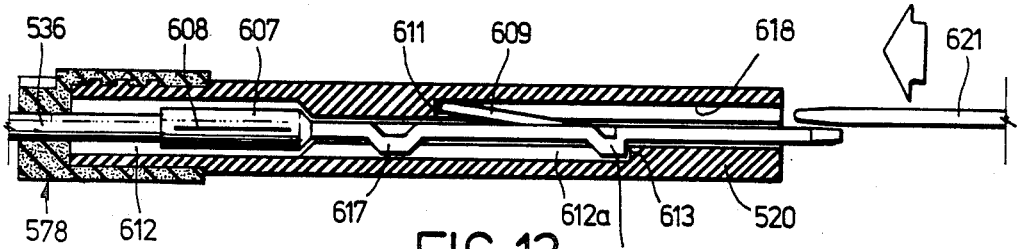
FIG. 13 is a cross-sectional view illustrating the contact of FIG. 12 positioned within a module passageway.

FIGS. 12 and 13 illustrate an electrical contact 600 according to an alternative embodiment of the invention for terminating the conductor wires 536 within a module, for example, module 520. Although electrical contact 600 includes a male terminal portion 602, contact 600 could equally as well be formed with a female terminal portion by replacing the male terminal portion 602 with a female receptable portion. Contact 600 comprises a generally elongated, one-piece member which includes a terminal portion 602 at one end; a central contact retention portion 603; and a conductor wire receiving portion 604 at the opposite end. Conductor wire-receiving portion 604 comprises essentially a hollowed-out cylinder or barrel 607 adapted to receive the end of a conductor wire after the insulation has been removed. The walls of hollowed-out cylinder are provided with a plurality of raised ribs 608 extending axially of the cylinder. In use, the exposed end of a conductor wire 536 is inserted into hollowed-out cylinder 607 and the cylinder is then firmly crimped radially inward and around the wire to secure the electrical contact 600 to the conductor. The ribs 608 in the wall of the cylinder are raised radially outward of the cylinder during inward deformation of the cylinder to an extent to firmly retain the contact 600 on the conductor wire and to maintain a reliable electrical connection without the use of solder or the like.

Central, contact retention ortion 603 comprises a flattened portion from which a generally U-shaped portion 603*a* is cut away to define a spirng finger 609. Spring finger 609 extends rearwardly of the contact and is bent upwardly at a slight angle. Spring finger 609 is adapted to cooperate with stops 611 formed incontact-receiving passageways 612 in module 520, as illustrated in FIG. 13. The passageways 612 are also provided with a pair of channels 612*a* having front walls 613. Channels 612*a* are positioined to receive a pair of stops 614 formed on contact 600 as shown in FIG. 12. Stops 614 are formed by stamping the flattened central portion of electrical contact 600.

In use, a contact 600 with conductor wire 536 secured thereto is inserted into module 520 from the rear and pushed forwardly within a passageway 612 until spring member 609 clears shoulder 611 at which point the spring finger 609 will spring upwardly to secure the contact in place within the module and prevent its rearward movement. Further forward movement of the contact within the module will be limited by stops 614 which impinge upon the front wall 613 of cahnnels 612*a*. Portions 614 of the contact in conjunction with deformed portions 617 restrict vertical movement of the contact within the module. Thus, the contact 600 is securely positioned within module 520 and will remain in position during use of the connector.

A contact 600 can be easily removed from the module 520 by inserting an appropriate tool 621 into portion 618 of its passageway 612 in the module through the front end, pressing the tool against the spring member 609 and holding it dows as the contact is withdrawn from the rear end of the module.

A particularly desirable feature of contact 600 and the contacts of the other embodiments is that the contacts are removably mounted within the modules. Accordingly, should the removal or placement of a contact be desired or necessary, the contact can be removed and replaced without destruction of the module. In prior systems, the contacts were permanently secured within the modules and could not be removed.

A further advantage of the contact system illustrated in FIGS. 12 and 13 is that separate retention pins or the like, which can become mislaid, are not required. The contacts and sealing means described and illustrated in FIGS. 9–13 may be applied to a right-angle connector such as that illustrated in FIG. 8 and to a multiple-row connector such as illustrated in FIG. 7.

While what has been described constitutes the presently preferred embodiments of the invention, it should be understood that the invention could take various other forms. It is accordingly intended that the invention be limited only insofar as it is required by the scope of the following claims:

I claim:

1. A connector comprising a housing, at least one module adapted to be received within said housing, said module including means for receiving a plurality of electrical conductors therein, and positioning means for positioning said module within said housing, characterized in that, said housing includes a receiving portion and a cover portion, said cover portion being releasably mountable to said receiving portion for releasably enclosing said module within said housing, said positioning means includes locking means on said housing and said module for locking said module laterally and longitudinally within said housing, said locking means including an interengaging ribbed structure and channel structure on said housing and said module, said module includes means for receiving a plurality of rows of conductor wires, said cover portion includes first and second portions releasably mountable to opposite sides of said receiving portion.

2. A connector comprising a housing, at least one module adapted to be received within said housing, said module including means for receiving a plurality of electrical conductors therein, and positioning means for positioning said module within said housing, characterized in that, said housing includes a receiving portion and a cover portion, said cover portion being releasably mountable to said receiving portion for releasably enclosing said module within said housing, said positioning means includes locking means on said housing and said module for locking said module laterally and longitudinally within said housing, said locking means including an interengaging ribbed structure and channel structure on said housing and said module, and sealing means for sealing around said plurality of electrical conductors and between said receiving portion and said cover portion, said sealing means is integral with said module and extends from the rear end thereof, said sealing means includes a plurality of apertures extending therethrough for receipt of said electrical conductors.

3. A connector as recited in claim 2 further characterized in that said at least one module includes first and second modules and said sealing means includes first and second sealing means integral with said first and second modules, respectively, and extending from the rear ends thereof, and in that the upper surface of said first sealing means and the lower surface of said second sealing means include rippled surfaces and in that said receiving portion and said cover portion include rippled surfaces for mating with said rippled surfaces on said first and second sealing means for compressing said first and second sealing means therebetween.

4. A connector as recited in claim 3 further characterized in that said rippled surfaces on said receiving portion and cover portion include lateral grooves thereon for receiving said sealing means when said sealing means is compressed therebetween.

5. A connector as recited in claim 2 further characterized in that said sealing means includes a plurality of rows of apertures extending therethrough for receipt of said electrical conductors and rippled upper and lower surfaces, and in that said receiving portion and said cover portion include rippled surfaces for mating with said rippled surfaces on said sealing means for compressing said sealing means therebetween.

6. A connector as recited in claim 5 further characterized in that said sealing means includes lateral slot means extending thereacross between said rows of apertures.

7. A connector comprising a housing, at least one module adapted to be received within said housing, said module having a plurality of longitudinal passageways for receiving a plurality of contact-terminated conductor wires therein, and positioning means for positioning said module within said housing, characterized in that, said housing includes a receiving portion and at least one cover portion mountable on said receiving portion for substantially closing said housing and enclosing said module therein, said receiving portion having substantially rectangular longitudinal and lateral cross sections, upstanding sidewalls, a rear portion providing a rear opening for said conductor wires, and a front portion providing a front opening permitting a connection to said conductor wires, said receiving portion and said cover portion including self-aligning means for alignment of said cover portion with said receiving portion, said connector comprises, means for longitudinally positioning said contacts affixed to forward ends of said conductor wires within said passageways in said module and locking means for locking said module longitudinally and laterally within said housing, said locking means comprising a structure projecting from at least one surface of said module and a mating structure on at least one corresponding mating internal surface of said housing for engaging said module structure, and said cover portion includes first and second cover portions mounted to opposite sides of said receiving portion.

8. A connector comprising a housing, at least one module adapted to be received within said housing, said module including passageway means for receiving a plurality of electrical conductors therein, characterized in that said housing includes a receiving portion and a cover portion, said cover portion being releasably mountable to said receiving portion for releasably enclosing said module within said housing, and further characterized in that said module includes integral sealing means extending from one end thereof, said sealing means including a plurality of apertures aligned with said passageway means for receipt of said conductors, said sealing means being adapted to be compressed between said receiving portion and said cover portion when said cover portion is mounted to said receiving portion.

9. A connector as recited in claim 8 further characterized in that said receiving portion and said cover portion include lateral slots therein for receiving said sealing means when said sealing means is compressed therebetween.

10. A connector as recited in claim 8 further characterized in that said sealing means includes rippled upper and lower surfaces and in that said receiving portion and said cover portion include rippled surfaces for mating with said rippled surfaces on said sealing means for compressing said sealing means therebetween.

11. A connector as recited in claim 8 characterized in that said module includes a module having a plurality of rows of passageway means and in that said sealing means includes a plurality of rows of passageway means and in that said sealing means includes lateral slot means extending thereacross between said rows of apertures.

12. In an electrical connector comprising, at least one insulator module means for surrounding a wiring arrangement of wiring and electrical contacts connected to the wiring, a conductive housing including a receiving portion for receiving the module means and a cover portion releasably mounted to the receiving portion, the improvement comprising;

said receiving portion includes a floor, a front portion providing a fornt opening for access to said module means, a wall upstanding from said floor and defining a rear opening, sidewalls upstanding from said floor and connecting said front portion and said wall defining said rear opening, said cover portion includes a bottom surface, a front wall projecting from said bottom surface, a descending wall projecting from said bottom surface and cover sidewalls projecting from said bottom surface and releasably engageable with said sidewalls of said receiving portion, a plurality of channel segments in said floor and in said bottom surface and arranged in a first arrangement in said floor and arranged in a second arrangement in said bottom surface, said second arrangement being different from said first arrangement, each of said module means includes a first side provided with a plurality of projecting rib means for mated engagement with corresponding said channel segments, and each of said module means includes a flat second side opposite said first side.

13. In an electrical connector as recited in claim 12, the improvement comprising;

said rib means are rib segments provided with multiple sides and slanted forward faces, said channel segments mateably engage with said rib segments and surround and engage said multiple sides, and said channel segments are provided with angled forward faces, said angled forward faces mateably engage said slanted forward faces of said rib segments.

14. In an electrical connector as recited in claim 12, the improvement further comprising;

said module means is a single insulator module having said flat second side engageable against and facing said housing, said rib means are rib segments provided with multiple sides and slanted forward faces, and said channel segments mateably engage with said rib segments and surround and engage said multiple sides and are provided with angled forward faces, said angled forward faces mateably engage said slanted forward faces of said rib segments.

15. In an electrical connector as recited in claim 12, the improvement further comprising;

said module means is a pair of insulator modules surrounding corresponding said wiring and corresponding said plurality of electrical contacts, said flat second sides of said pair of insulator modules engage each other, and said rib means of said pair of insulator modules engage said plurality of channel segments in said cover portion and said receiving portion.

16. In an electrical connector as recited in claim 12, the improvement further comprising;

said cover sidewalls include projecting flanges that engage with said sidewalls of said receiving portion and lock said cover portion and said receiving portion against movement laterally with respect to each other, tongue and groove means facing forward on said cover portion and facing rearward on said receiving portion for interengaging with one another upon forward movement of said cover portion with respect to said receiving portion, and said front portion of said receiving portion having a rear wall, said front wall of said cover portion abutting said rear wall upon said forward movement of said cover portion with respect to said receiving portion.

17. In an electrical connector as recited in claim 12, the improvement further comprising;

strain relief means engaging and conforming to a shape of said upstanding wall of said receiving portion, said strain relief means engaging said wiring for providing strain relief for said wiring.

18. In an electrical connector as recited in claim 17, the improvement further comprising;

said strain relief means includes a strain relief pad mounted on said upstanding wall.

19. In an electrical connector as recited in claim 17, the improvement further comprising;

said strain relief means includes a strain relief boot attached to said module means.

20. In an electrical connector as recited in claim 19, the improvement further comprising;

said strain relief boot includes rippled surfaces, and said upstanding wall includes rippled surfaces conforming to corresponding said rippled surfaces of said strain relief boot.

21. In an electrical connector as recited in claim 20, the improvement further comprising;

said cover portion includes rippled surfaces conforming to corresponding said rippled surfaces of said strain relief boot.

22. In an electrical connector as recited in claim 13, the improvement further comprising;

said cover sidewalls include projecting flanges that engage with said sidewalls of said receiving portion and lock said cover portion and said receiving portion against movement laterally with respect to each other, tongue and groove means facing forward on said cover portion and facing rearward on said receiving portion for interengaging with one another upon forward movement of said cover portion with respect to said receiving portion, and said front portion of said receiving portion having a rear wall, said front wall of said cover portion abutting said rear wall upon said forward movement of said cover portion with respect to said receiving portion.

23. In an electrical connector as recited in claim 14, the improvement further comprising;

said cover sidewalls include projecting flanges that engage with said sidewalls of said receiving portion and lock said cover portion and said receiving portion against movement laterally with respect to each other, tongue and groove means facing forward on said cover portion and facing rearward on said receiving portion for interengaging with one another upon forward movement of said cover portion with respect to said receiving portion, and said front portion of said receiving portion having a rear wall, said front wall of said cover portion abutting said rear wall upon said forward movement of said cover portion with respect to said receiving portion.

24. In an electrical connector as recited in claim 15, the improvement further comprising;

said cover sidewalls include projecting flanges that engage with said sidewalls of said receiving portion and lock said cover portion and said receiving portion against movement laterally with respect to each other, tongue and groove means facing forward on said cover portion and facing rearward on said receiving portion for interengaging with one another upon forward movement of said cover portion with respect to said receiving portion, and said front portion of said receiving portion having a rear wall, said front wall of said cover portion abutting said rear wall upon said forward movement of said cover portion with respect to said receiving portion.

25. In an electrical connector as recited in claim 13, the improvement further comprising;

strain relief means engaging and conforming to a shape of said upstanding wall of said receiving portion, said strain relief means engaging said wiring for providing strain relief for said wiring.

26. In an electrical connector as recited in claim 14, the improvement further comprising;

strain relief means engaging and conforming to a shape of said upstanding wall of said receiving portion, said strain relief means engaging said wiring for providing strain relief for said wiring.

27. In an electrical connector as recited in claim 15, the improvement further comprising;

strain relief means engaging and conforming to a shape of said upstanding wall of said receiving portion, said strain relief means engaging said wiring for providing strain relief for said wiring.

28. In an electrical connector as recited in claim 16, the improvement further comprising;

strain relief means engaging and conforming to a shape of said upstanding wall of said receiving portion, said strain relief means engaging said wiring for providing strain relief for said wiring.

29. A connector for a wiring arrangement, comprising:

housing means formed of receiving means and cover means mounted on the receiving means, said receiving means having substantially rectangular longitudinal and lateral corss sections, upstanding side walls, a rear portion providing a rear opening for a wiring arrangement, a front portion providing a front opening for enabling connection to said wiring arrangement, and a floor portion to which said front portion, said side walls and said rear portion are connected, said floor portion including a substantially flat upper surface within said housing means, insulator module means for receipt in said receiving means having a plurality of longitudinal passageways for laterally aligning conductive wiring of said wiring arrangement and including means for longitudinally aligning conductive electrical contacts of said wiring arrangement conductively affixed to forward ends of said wiring, said cover means being mountable on at least one of said side walls and forwardly against said front portion for substantially closing said housing means and enclosing said module means therein, said cover means including a substantially flat bottom surface mountable over said receiving means and within the housing means, said cover means including self aligning means for alignment with and in engagement with said receiving means, and locking means on said module means and said housing means for locking said module means longitudinally and laterally within said housing means, said locking means comprising a ribbed structure projecting from said module means and a plurality of channels on at least one internal surface of said housing means for engaging said ribbed structure, said self aligning means further comprising a vertically depending front wall for engaging a rear vertical wall of said front portion thereby to prevent forward movement of said cover means beyond a predetermined forward position with respect to said receiving means, and tongue and groove means extending forwardly of said cover means and rearwardly of said front portion and interengaging together with engagement of said vertically depending front wall and said rear vertical wall of said front portion for preventing vertical, forward and transverse movement of said cover means with respect to said receiving means after forward engagement therewith.

30. A connector as recited in claim 29 wherein said ribbed structure includes a segmented rib having a plurality of rib segments of predetermined length and height and wherein said plurality of channels are provided as a plurality of channel segments having length and depth dimensions opposing and mating with said rib segments for interlocking with said rib segments and for preventing longitudinal or lateral movement of said module means within said housing means.

31. A connector as recited in claim 30 wherein said segmented rib is arranged laterally with respect to said module means, and said plurality of channels include a plurality of lateral channels on at least one of the upper surface of said floor portion and the bottom surface of said cover means.

32. A connector as recited in claim 31 wherein said ribbed structure includes a plurality of lateral rib segments on an upper surface of said module means and a plurality of lateral rib segments on a bottom surface of said module means, and wherein said plurality of channels includes a plurality of lateral channels on the upper surface of said floor portion for engaging said rib segments on the bottom surface of said module means and a plurality of lateral channels on the bottom surface of said cover means for engaging said rib segments on the upper surface of said module means.

33. A connector as recited in claim 30 wherein said plurality of channels includes a plurality of L-shaped channels.

34. A connector for a wiring arrangement, comprising:

housing means formed of receiving means and cover means mounted on the receiving means, said receiving means having substantially rectangular longitudinal and lateral cross sections, upstanding side walls, a rear portion providing a rear opening for a wiring arrangement, a front portion providing a front opening for enabling connection to said wiring arrangement, and a floor portion to which said front portion, said side walls and said rear portion are connected, said floor portion including a substantially flat upper surface within said housing means, insulator module means for receipt in said receiving means having a plurality of longitudinal passageways for laterally aligning conductive wiring of said wiring arrangement and including means for longitudinally aligning conductive electrical contacts of said wiring arrangement conductively affixed to forward ends of said wiring, said cover means being mountable on at least one of said side walls and forwardly against said front portion for substantially closing said housing means and enclosing said module means therein, said cover means including a substantially flat bottom surface mountable over said receiving means and within the housing means, said cover means including self aligning means for alignment with and in engagement with said receiving means, and locking means on said module means and said housing means for locking said module means longitudinally and laterally within said housing means, said locking means comprising a ribbed structure projecting from said module means and a plurality of channels on at least one internal surface of said housing means for engaging said ribbed structure, said self aligning means of said cover means comprises side walls depending from said bottom surface thereof for engaging said upstanding side walls of said receiving means and flange means descending from said depending side walls and laterally positioned to engage inner surfaces of said upstanding side walls thereby to lock said cover means laterally with respect to said receiving means, said self aligning means further comprises a vertically depending front wall of said cover means for engaging a rear vertical wall of said front portion thereby to prevent forward movement of said cover means beyond a predetermined forward position with respect to said receiving means, said self aligning means further comprises tongue and groove means extending forwardly of said cover means and rearwardly of said front portion and interengaging together with engagement of said vertically depending front wall and said rear vertical wall of said front portion for preventing vertical, forward and transvers movement of said cover means with respect to said receiving means after forward engagement therewith.

35. A connector as recited in claim 29 wherein said means for longitudinally aligning contacts comprises pin means, said module means comprising a plurality of transverse holes for said pin means, the wiring arrangement including a plurality of contact means attacahed to said wiring, said contact means including portions shaped to receive said pin means only when said contact means is in a predetermined appropriate longitudinal position, said pin means engaging said shaped portion of said contact means thereby preventing longitudinal movement of said contact means from said predetermined position.

36. A connector as recited in claim 29 wherein said front portion is dimensioned sufficiently large to pass said module means therethrough but sufficiently small to prevent passage therethrough of said ribbed structure projecting from said module means.

37. A connector as recited in claim 29 wherein said rear portion includes upstanding rear wall means and said cover means includes descending rear wall means opposing said upstanding rear wall means and cooperating therewith to clamp a portion of said wiring arrangement to said housing means and thereby to provide strain relief for said wiring arrangement.

38. A connector as recited in claim 37 further comprising strain relief pad means projecting from said upstanding rear wall means and including a laterally extending channel mating with said descending rear wall means for providing a tortuous path for said wiring arrangement and for providing said strain relief thereto.

39. A connector as recited in claim 34 wherein, said ribbed structure includes a segmented rib having a plurality of rib segments of predetermined length and height and wherein said plurality of channels are provided as a plurality of channel segments having length and depth dimensions opposing and mating with said rib segments for interlocking with said rib segments and for preventing longitudinal or lateral movement of said module means within said housing means.

40. A connector as recited in claim 29 wherein, said ribbed structure extends laterally with respect to said module means, and said plurality of channels project laterally of at least one of the upper surface of said floor portion and the bottom surface of said cover means.

41. A connector as recited in claim 29 wherein, said ribbed structure includes a plurality of lateral rib segments on an upper surface of said module means ana a plurality of lateral rib segments on a bottom surface of said module means, and wherein said plurality of channels includes a plurality of lateral channels on the upper surface of said floor portion for engaging said rib segments on the bottom surface of said module means and a plurality of lateral channels on the bottom surface of said cover means for engaging said rib segments on the upper surface of said module means.

42. A connector as recited in claim 30 wherein, said self aligning means of said cover means comprises depending side walls depending from a bottom surface thereof for engaging said upstanding side walls of said receiving means, and flange means descending from said depending side walls and laterally positioned to engage inner surfaces of said upstanding side walls thereby to lock said cover means laterally with respect to said receiving means.

43. A connector as recited in claim 30 wherein, said means for longitudinally aligning contacts comprises pin means, said module means comprises a plurality of transverse holes for said pin means, the wiring arrangement includes a plurality of contacts attached to said wiring, said contacts include portions shaped to receive said pin means only when said contacts are in a predetermined appropriate longitudinal position, and said pin means engages said shaped portion of said contacts thereby preventing longitudinal movement of said contacts from said predetermined position.

44. A connector as recited in claim 34 wherein, said front portion is dimensioned sufficiently large to pass said module means therethrough but sufficiently small to prevent passage therethrough of said ribbed structure projecting from said module means.

* * * * *